US007353878B2

(12) United States Patent
Themig

(10) Patent No.: US 7,353,878 B2
(45) **Date of Patent: *Apr. 8, 2008**

(54) APPARATUS AND METHOD FOR WELLBORE ISOLATION

(75) Inventor: Daniel Jon Themig, Calgary, CA (US)

(73) Assignee: Packers Plus Energy Services Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/315,494

(22) Filed: Dec. 23, 2005

(65) Prior Publication Data

US 2006/0090906 A1 May 4, 2006

Related U.S. Application Data

(63) Continuation of application No. 10/604,811, filed on Aug. 19, 2003, now Pat. No. 7,021,384.

(60) Provisional application No. 60/404,783, filed on Aug. 21, 2002.

(51) Int. Cl.
*E21B 43/14* (2006.01)

(52) U.S. Cl. ..... 166/313; 166/50; 166/133; 166/188

(58) Field of Classification Search ..... 166/50, 166/313, 133, 188, 305.1
See application file for complete search history.

(56) References Cited

U.S. PATENT DOCUMENTS 1,785,277 A * 12/1930 Mack ..... 166/123
2,352,700 A * 7/1944 Ferris ..... 166/120
3,035,639 A * 5/1962 Brown et al. ..... 166/150
3,333,639 A * 8/1967 Page et al. ..... 166/120
5,325,924 A 7/1994 Bangert et al.
5,454,430 A 10/1995 Kennedy et al.
5,941,307 A * 8/1999 Tubel ..... 166/313
6,079,493 A 6/2000 Longbottom et al.
6,311,776 B1 11/2001 Pringle et al.
6,349,772 B2 * 2/2002 Mullen et al. ..... 166/387
6,388,577 B1 * 5/2002 Carstensen ..... 340/854.3
2001/0009189 A1 7/2001 Brooks et al.

OTHER PUBLICATIONS

Information on RockSeal Open Hole Packers, these or similar packers believed to be publicly available in the US prior to Aug. 19, 2002.

* cited by examiner

*Primary Examiner*—Hoang Dang
(74) *Attorney, Agent, or Firm*—Bennett Jones LLP

(57) ABSTRACT

An apparatus for isolating a selected leg of a wellbore from the remainder of the wellbore includes a packer positionable in the selected leg of the wellbore, a tube extending through the packer from an uphole side of the packer to a downhole side of the packer to permit a fluid flow communication to the selected leg of the wellbore past the packer and a valve positioned in the tube to control fluid flow through the tube. In a method for isolating a selected leg of a wellbore, the apparatus is positioned in the selected wellbore leg and the packer set to permit fluid flow communication past the apparatus only through the tube and the valve of the apparatus.

16 Claims, 1 Drawing Sheet

APPARATUS AND METHOD FOR WELLBORE ISOLATION

CROSS REFERENCE TO RELATED APPLICATIONS

This is a continuation application of U.S. application Ser. No. 10/604,811 filed Aug. 19, 2003, now U.S. Pat. No. 7,021,384, issued Apr. 4, 2006. U.S. application Ser. No. 10/604,811 and the present application claim priority from U.S. provisional patent application Ser. No. 60/404,783 filed Aug. 21, 2002.

BACKGROUND OF INVENTION

An apparatus and a method for wellbore isolation are taught and, in particular, the invention relates to an apparatus and a method for isolating, with controlled access, a lateral wellbore from the remainder of the wellbore.

A well may be drilled with multiple legs or laterals that may be vertical, inclined or horizontal, deviated, straight or otherwise. When junctions to the legs are created, isolating one or more legs from the remainder of the wellbore can be especially important to protect the isolated leg or legs from other drilling operations including fluids and debris, to provide the ability to stimulate wellbore legs individually and/or to control fluid flow from the lateral wellbore.

SUMMARY OF INVENTION

An apparatus for wellbore isolation has been invented that permits isolation of a selected wellbore from the remainder of the well. The apparatus is mountable in the selected lateral wellbore, so as not to impede access to non-isolated portions of the well.

Thus, in one aspect of the present invention, there is provided an apparatus for isolating a selected leg of a wellbore from the remainder of the wellbore: comprising a packer positionable in the selected leg of the wellbore, a tube extending through the packer from an uphole side of the packer to a downhole side of the packer to permit a fluid flow communication to the selected leg of the wellbore past the packer and a valve positioned in the tube to control fluid flow through the tube.

The apparatus isolates the selected wellbore leg from the remainder of the wellbore, but the provision of a valve permits controlled access to and/or flow from the selected wellbore leg. The selected wellbore leg can vary between a vertical and a horizontal orientation, be open hole or lined, straight or deviated, etc.

The tube can be a mandrel of the packer or another section of tubing installed to extend though the packer. The tube can be connected to a tubing string on the downhole side of the packer, which extends into the selected wellbore leg. The tubing string can be selected to act against wellbore cave in or can be configured to permit wellbore stimulation procedures such as fracturing, sprinkling, cleaning, etc. In one embodiment, the tube, at its uphole end, includes a portion for accepting a tool from surface such as, for example, an end of a tubing string, a seal, a valve or packer actuator tool. In addition to fluid flow, the tube can permit passage of tools therethrough, if desired.

The valve is selected, when closed, to substantially seal against fluid flow therethrough and, thereby through the tube and through the wellbore past the packer. The valve can be selected to permit one-way or two-way fluid flow control. The valve can, for example, be a check valve or an actuable valve. In one embodiment, the valve is openable by actuation from surface by use, for example, of a tubing string or line conveyed actuator. The valve can be positioned anywhere along the tube to control fluid flow through the tube between its uphole end and its downhole end. In addition to fluid flow, the valve can be selected to permit passage of tools through the tube.

The packer acts to seal fluid flow communication to and from the wellbore except through the tube and valve. The packer can also provide assist in anchoring the apparatus in the selected wellbore. The packer can be of any type, capable of effecting a substantial seal between the tube and the wall of the selected wellbore leg. The packer can be selected, as will be appreciated, based on wellbore conditions, desired permanency of the seal, wellbore wall parameters, etc. In one embodiment, which is particularly beneficial in open hole conditions, the packer is a solid body packer. A solid body packer creates a seal between the tube and the borehole wall, be it lined or open hole, using a packing element, which is mechanically extruded by either mechanically or hydraulically applied force. The solid body packers provide high pressure sealing in open holes and can be equipped with multiple packing elements that will load into each other to provide additional pack-off.

The apparatus can include stabilizers for anchoring the packer in the wellbore, as may be required where there is a considerable pressure differential about the packer. The apparatus can include slips selected to engage the borehole wall. These slips can, for example, be mounted in association with the packer or the tube. Another stabilizer can include a tie back to the borehole from which the selected wellbore leg extends.

With reference to the foregoing, in another broad aspect of the present invention, there is provided a method for isolating a selected wellbore leg from the remainder of the wellbore, the method comprising: providing an apparatus according to one of the embodiments of the present invention; positioning the apparatus in the selected wellbore leg such that the valve of the apparatus is positioned within the selected wellbore leg; and expanding the packer to seal between the tube and the wall of the selected wellbore.

In one embodiment, the method includes positioning the apparatus in the selected wellbore leg such that the tube of the apparatus and preferably the uphole end of the tube is within the selected wellbore leg. The method can include anchoring the apparatus in the selected wellbore leg.

In the method, the valve of the apparatus can be opened to permit fluid flow communication with the selected wellbore leg. Fluid flow communication can be for introduction of cleaning, completion or stimulation fluids, production therefrom, etc. For example, the method can include deploying a tubing string from surface, connecting the tubing string to the tube of the apparatus and pumping wellbore treatment fluids down the tubing string and through the tube of the apparatus into the selected lateral. The tubing string can include an actuator for opening the valve of the apparatus and the method can include manipulating the tubing string to open the valve of the apparatus.

In the method, the apparatus can be left in the well for continued or future isolation. Alternately, the valve of the apparatus can be removed or the entire apparatus can be removed once it is no longer desired to isolate the selected wellbore. wellbore.

DETAILED DESCRIPTION

Figure 1:
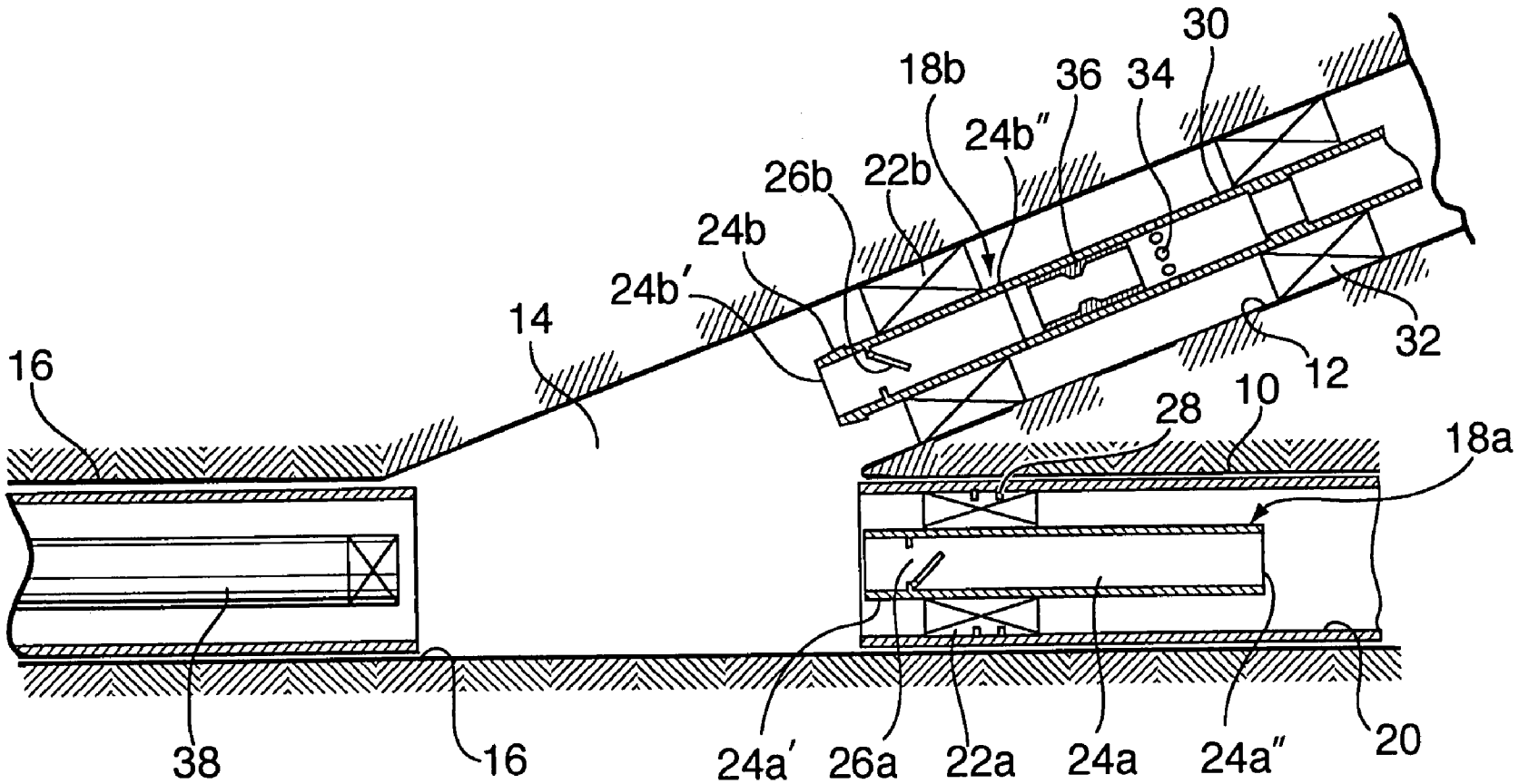
FIG. 1 is a schematic view through a wellbore having multiple legs and having installed in each of the legs an apparatus according to the present invention.

Referring to FIG. 1, there is shown a sectional view through a wellbore including multiple lateral wellbore legs 10, 12 extending from a junction 14. A borehole 16 extending uphole from the junction and is connected to surface.

Legs 10, 12 each have disposed therein an apparatus 18*a*, 18*b* for isolating, with controlled communication therewith, each of the legs from the remainder of the wellbore. Leg 10 is lined with a liner or casing 20, while leg 12 is open hole.

Apparatus 18*a* illustrates one embodiment of the invention and includes a packer 22*a* positioned in the leg of the wellbore, a tube 24*a* extending through the packer from an uphole end 24*a*' on an uphole side of packer 22*a* to a downhole end 24*a*" on a a downhole side of the packer. Tube 24*a* permits a fluid flow communication between the borehole 16 and leg 10 past the packer. The apparatus further includes a valve 26*a* positioned in the tube to control fluid flow through the tube and anchoring slips 28 in association with the packer. The slips include whickers that bite into the material of the liner to stabilize the packer in the wellbore leg.

Apparatus 18*a*, and in particular, valve 26*a* and packer 22*a*, prevents debris and fluids from the remainder of the wellbore from passing into wellbore leg 10. However, the valve is openable, as by a check arrangement such as a ball valve or flapper valve, to permit one-way fluid flow, such as of produced fluids, from the leg 10 to borehole 16 through the tube. The valve can include a pressure control, which operates to permit fluid only at pressures exceeding a selected pressure to open the valve.

Apparatus 18*b* also includes a packer 22*b* positioned in the leg of the wellbore, a tube 24*b* extending through the packer from an uphole end 24*b*' to a downhole end 24*b*" to permit a fluid flow communication between the borehole 16 and leg 12 past the packer and a valve 26*b* positioned in the tube to control fluid flow through the tube. Apparatus 18*b* is positioned close adjacent junction 14. However, it could be spaced back a distance from the wellbore junction, if desired.

Apparatus 18*b* isolates wellbore leg 12 from the remainder of the wellbore for the purpose of selective injection of wellbore treatment fluids into the leg for the purpose, for example, of wellbore stimulation. As such, tube 24*b* at its downhole end is connected into a tubing string 30 for conveying stimulation fluids to selected intervals of the leg. Tubing string 30 includes a plurality of packers 32 (only one can be seen in the drawing) thereabout which divide the leg into a plurality of treatment segments. The tubing string can include ports 34 opened by sleeves 36 (only one can be seen) operable by fluid pressure created by the seating therein of a sealing device, such as a ball. As such, valve 26*b* is selected to permit passage of the sealing devices used to actuate sleeves 36. Tubing strings similar to tubing string 30 and methods for using those tubing strings for stimulation of a formation are described in detail in applicant's corresponding application U.S. 2003/0127227, published in July, 2003.

Packer 22*b* is a solid body open hole packer such as is available from the assignee of this application. Valve 26*b* is a one-way check valve, for example of the flapper type, that can be opened to permit fluid flow through the tube from its uphole end 24*b*' to its downhole end 24*b*", but not in the reverse. The valve is actuable to be opened by pressures exceeding its flapper force. Valve 26*b* is opened for example by pumping of fluids therethrough at normal treatment pressures. Treatment fluids can be pumped through a tubing string 38, such as coiled tubing, which is connectable to uphole end 24*b*' of the tube. Uphole end 24*b*' can be formed as by provision of locking dogs, seals, polishing, collets, etc. to accept and retain the end of the tubing string 38 so that it is secured during wellbore treatment through apparatus 18*b*. If desired, the valve of the apparatus can be formed to cooperate with tubing string or a part connected thereto such that the valve is openable by connection of a tubing string, or other member conveyed from surface, to the apparatus.

Packers 32 act to anchor the tubing string and apparatus 18*b* against the pressure differentials that are created during wellbore treatment.

In use to isolate a wellbore leg from the remainder of the wellbore, the apparatus such as that identified as 18*a* or 18*b*, is positioned in the selected wellbore leg such that the uphole end of the tube is positioned within the selected wellbore leg and open to the wellbore above the packer. The packer is then expanded to seal between the tube and the wall, which can be open hole or lined, of the selected wellbore leg. If stabilizers, such as slips 28 and/or additional packers 32 are used, they should also be set. The packer and valve of the apparatus act to substantially seal and, therefore, isolate the selected wellbore leg below the packer from the remainder of the well.

In one embodiment, the method includes opening the valve to permit fluid flow communication to the selected wellbore leg. Fluid flow communication can be for introduction of fluids such as, for example, cleaning, completion or stimulation fluids to the isolated leg or release of fluids, such as production fluids, from the wellbore leg, etc. The method can also include passing tools, such as sealing devices noted hereinbefore with respect to tubing string 30, through the valve of the apparatus.

To convey fluids to the apparatus, they can be pumped downhole such as through tubing string 38. Tubing string 38 can be operable to open the valve of the apparatus to permit pumping of fluid to the wellbore leg. Alternately or in addition, the valve can be pressure controlled, openable by pressures, which exceed a selected pressure.

In the method, the apparatus can be left in the well for continued or future isolation or removed once it is no longer needed. In one embodiment, the valve can be sheared out or opened to permit production through the apparatus.

While preferred embodiments have been shown and described, these are intended for illustration and not for limitation. Various modifications and substitutions may be made thereto without departing from the spirit and scope of the invention.

The invention claimed is:

1. For use in conjunction with a wellbore of the type having an open hole wellbore leg extending therefrom, a method of isolating the open hole wellbore leg from the remainder of the wellbore comprising the steps of:

providing a tube having an exterior and an interior;

providing a tubular packer;

mounting the tubular packer about the exterior of the tube to form a packer/tube assembly;

providing a plurality of slips;

mounting each of the slips comprising the plurality thereof about the exterior of the packer/tube assembly;

providing means for selectively extending the slips outwardly relative to the exterior of the tube;

providing a one-way check valve;

mounting the one-way check valve within the tube;

positioning the packer/tube assembly having the slips mounted thereon and having the one-way check valve mounted therein within the open hole wellbore leg of the wellbore;

thereafter extending the slips relative to the exterior surface of the tube and thereby securing the packer/tube assembly within the open hole wellbore leg of the wellbore; and thereafter utilizing the one-way check valve and the tubular packer to control the flow of fluids into the open hole wellbore leg from the remainder of the wellbore.

2. The method of claim 1 further comprising opening the one-way check valve to permit fluid flow communication with the open hole wellbore leg.

3. The method of claim 1 further comprising introducing wellbore treatment fluids through the tube and the one-way check valve into the open hole wellbore leg.

4. The method of claim 3 wherein the one-way check valve of the apparatus is selected to permit one way fluid flow through the tube into the open hole wellbore leg such that the wellbore treatment fluids are isolated in the open hole wellbore leg.

5. The method of claim 1 further comprising deploying a tubing string from surface; connecting the tubing string to the tube; and pumping wellbore treatment fluids down the tubing string and through the tube into the open hole wellbore leg.

6. The method of claim 5 further comprising manipulating the tubing string to open the one-way check valve.

7. The method of claim 1 wherein the tubular packer is a solid body packer.

8. The method of claim 1 wherein the plurality of slips including whickers thereon and in the step of extending the slips, the whickers on the slips are driven to bite into a wall of the open hole wellbore leg.

9. For use in conjunction with a wellbore of the type having an open hole wellbore leg extending therefrom, a method of isolating the open hole wellbore leg from the remainder of the wellbore comprising the steps of:

providing a packer assembly including a tube having an exterior and an interior, a tubular packer mounted about the exterior of the tube, a plurality of slips mounted on the packer assembly and selectively extendable outwardly relative to the exterior of the tube; and a one-way check valve mounted within the tube;

positioning the packer assembly within the open hole wellbore leg of the wellbore;

thereafter extending the slips relative to the exterior surface of the tube and thereby securing the packer assembly within the open hole wellbore leg of the wellbore; and thereafter utilizing the one-way check valve and the tubular packer to control the flow of fluids into the open hole wellbore leg from the remainder of the wellbore.

10. The method of claim 9 further comprising opening the one-way check valve to permit fluid flow communication with the open hole wellbore leg.

11. The method of claim 9 further comprising introducing wellbore treatment fluids through the tube and the one-way check valve into the open hole wellbore leg.

12. The method of claim 11 wherein the one-way check valve of the apparatus is selected to permit one way fluid flow through the tube into the open hole wellbore leg such that the wellbore treatment fluids are isolated in the open hole wellbore leg.

13. The method of claim 9 further comprising deploying a tubing string from surface; connecting the tubing string to the tube; and pumping wellbore treatment fluids down the tubing string and through the tube into the open hole wellbore leg.

14. The method of claim 13 further comprising manipulating the tubing string to open the one-way check valve.

15. The method of claim 9 wherein the tubular packer is a solid body packer.

16. The method of claim 9 wherein the plurality of slips including whickers thereon and in the step of extending the slips, the whickers on the slips are driven to bite into a wall of the open hole wellbore leg.

* * * * *